United States Patent [19]

Swenson

[11] Patent Number: 4,701,146

[45] **Date of Patent: * Oct. 20, 1987**

[54] ILLUMINATED INFANT TOY

[75] Inventor: Paula S. Swenson, Golden, Colo.

[73] Assignee: Neptune Corporation, Golden, Colo.

[ * ] Notice: The portion of the term of this patent subsequent to May 13, 2003 has been disclaimed.

[21] Appl. No.: 815,940

[22] Filed: Jan. 3, 1986

Related U.S. Application Data

[63] Continuation-in-part of Ser. No. 583,633, Feb. 27, 1984, Pat. No. 4,588,387.

[51] Int. Cl.[4] ..... A63H 33/26

[52] U.S. Cl. ..... 446/130; 446/439; 446/409; 446/485; 273/58 G; 362/802; 362/809; 335/206

[58] Field of Search ..... 446/130, 409, 485, 439, 446/438, 242, 419, 418, 170, 484, 431; 273/58 G, 58 E; 362/802, 809, 806, 363; 335/206

[56] References Cited

U.S. PATENT DOCUMENTS

| | | | |
|---|---|---|---|
| 1,959,835 | 5/1934 | Meginnis . | |
| 2,484,159 | 10/1949 | Flynn, Jr. | 446/485 X |
| 2,493,491 | 1/1959 | MacMahon . | |
| 2,634,407 | 4/1953 | Johnson . | |
| 2,903,820 | 9/1959 | Bodell | 446/439 |
| 2,972,739 | 2/1961 | Opper . | |
| 3,304,651 | 2/1967 | Deyerl | 446/439 |
| 3,391,935 | 7/1968 | Gross . | |
| 3,584,212 | 6/1971 | Hansen | 362/802 X |

*Primary Examiner*—Mickey Yu

*Attorney, Agent, or Firm*—Fields, Lewis, Pittenger & Rost

[57] ABSTRACT

A rattle for an infant is provided wherein the noise making device within the rattle also is a light activation device to momentarily light, in sequence, a plurality of lights mounted on the rattle. The noise-making device is made of magnetic material and is moved back and forth in a tube within the rattle so as to activate reed switches adjacent to the tube thereby sequentially illuminating the lights. The device is powered by batteries mounted in a handle on the rattle. In one form of the invention, the toy is elongated in shape and the magnetic member moves along a straight tubular path. In another embodiment, the magnetic member moves along an annular path and the toy is spherical.

15 Claims, 6 Drawing Figures

ILLUMINATED INFANT TOY

DESCRIPTION

This application is a continuation-in-part of my copending application, Ser. No. 583,633, filed Feb. 27, 1984, now U.S. Pat. No. 4,588,387.

1. Technical Field

This invention relates to an illuminated infant toy, and more particularly to a rattle for an infant wherein the device which makes the rattling noise also functions to cause the rattle to be intermittently illuminated.

2. Background of the Invention

Various toys and other devices have been provided in the prior art wherein a ball is rolled along a predetermined path to cause one or more lights to be illuminated.

One such device is shown in U.S. Pat. No. 3,391,935 to Gross wherein a toy, having batteries located in the handle connected through a circuit means to a light bulb for illuminating the toy. The toy includes nested conical elements, supported by the handle and having electrical switches along the side surfaces thereof. A ball is provided within the device which is manipulated between the nested conical members and every time is passes over one of the switches, it closes the circuit and momentarily illuminates the light.

A flashlight switching device is shown in U.S. Pat. No. 1,959,835 to Meginnis wherein a pair of spring clips are provided at one end of a chamber and a pair of similar clips are provided at the other end of the chamber and connected in circuit to a light bulb. The light bulb is illuminated when a conducting ball is in engagement with the latter pair of clips. When it is desired to have the flashlight turned off, the flashlight is shaken or jarred so that the ball falls into the other pair of clips.

U.S. Pat. No. 2,493,491 to MacMahon discloses a two-headed flashlight with a passageway between dry cells, one dry cell being for each light. A steel conducting ball rolls along a passageway to one end or the other of the flashlight to alternately illuminate the lamps at opposite ends. The lamp can be turned off completely by allowing the ball to fall into a recess intermediate the passageway.

A flashlight having three contacts connected in series is shown in U.S. Pat. No. 2,972,739 to Opper. The circuit to the flashlight is closed when a conducting ball, which can roll along a pathway, contacts any one of the contact positioned in the pathway. If the flashlight is pivoted to cause the ball to roll between alternate pairs of contacts, the light will be alternately turned on and off. If the flashlight is rotated so that the ball falls into a recess to contact the third contact, the flashlight will remain illuminated. When it is desired to turn the flashlight off, it can be manipulated so that the ball falls into a recess and does not touch any of the contacts.

U.S. Pat. No. 2,634,407 to Johnson discloses an intermittently activated light for use by hunters as a safety device. In this device, a contact prong is mounted on the end of a spring and electrically connected to the spring by a battery. Oscillations of the spring due to movement of the hunter will cause the contact to vibrate and alternately close the circuit to one or the other of a pair of lights mounted on the device and connected in the circuit.

U.S. Pat. No. 3,584,212 to Hansen discloses a spirit level having a plurality of spirit level containers mounted therein with a light source in each one for selectively illuminating each one. A gravity switch is provided in a circular housing and includes a ball of conductive material which selectively closes normally open contacts of one or more of the light sources in the level depending on its position.

Although each of these devices has been suitable for its intended purpose, none of them disclose a rattle for an infant wherein the noise producing means of the rattle serves as an activation for illuminating lights intermittently on the rattle.

DISCLOSURE OF THE INVENTION

In accordance with this invention a hand operated toy is provided which provides both a sound and illumination response to the user. In one embodiment, the toy comprises a housing having a tube which has opposite closed ends. Noise-producing means is selectively movable back and forth within the tube from one end to the other creating a sound as it moves and upon impact with each end. A normally-open electrical switch means is mounted along the tube which is closed momentarily by the movable means each time it moves through the switch. A battery is mounted in the housing and light means in the housing is connected in circuit with the battery means and the switch means which is intermittently illuminated each time the switch means is closed by the movable means.

More specifically, the invention, as depicted in this embodiment, relates to an illuminated baby rattle having an elongated generally cylindrical housing with a longitudinal axis. A tube is provided within the housing lying along the axis and having opposite closed ends. A plurality of lights are spaced along the outside of the tube which are visible through the housing. A plurality of reed switches are spaced along the outside of the tube and have the same spacing as the light and a handle extends from one end of the housing. A battery compartment is provided in the handle for holding batteries and circuit means is connected to each in series with one of the reed switches to form a lighting set and the lighting sets are connecting in parallel to the batteries. A magnet in the tube can be rolled from one end of the tube to the other by gravity upon tipping the rattle back and forth to make a noise as it rolls back and forth through the tube. The magnet sequentially closes the reed switches as it rolls to sequentially illuminate lights. In one embodiment, the magnet is spherical and in another embodiment it is a disk which can roll end over end. Conveniently, the lights may be in the form of light emitting diodes spaced along the housing. A normally-open master switch can be provided in the end of the handle and connected in series with the batteries for activating the circuit.

In another embodiment, the toy has a generally spherical shape in which the batteries are mounted in a battery tube which runs from pole to pole and is surrounded adjacent the equator by a circuit board which contains a plurality of reed switches. A trackway in the form of an annulus is provided on the side of the circuit board opposite the reed switches and has a magnetic element therein which will move around the annulus as the spherical toy is rolled or turned so as to sequentially close the reed switches to complete the circuit to light means spaced around the periphery of the circuit board.

More particularly, in this alternate form of the invention, a hand operated toy is provided which is generally spherical and has a magnetic member movable along a circular path. A plurality of normally-open reed switches is mounted along the predetermined path in a circuit board adjacent thereto and have lights around the periphery thereof connected in the circuit which are illuminated each time one of the switches is closed. Battery means extends along an axis of the housing and comprises a battery tube therealong having a removable closure. A conductive ring is provided around the periphery of the circuit board for connecting the lights in the circuit. Conveniently, the magnetic member can be spherical.

Thus, in both embodiments a rattle for an infant is provided wherein the device which creates the sound in the rattle is made of magnetic material and performs the dual function of closing reed switches connected in circuit with light emitting diodes so that upon movement of the sound producing device through a tube in the rattle, the light emitting diodes will be sequentially lighted adding to the enjoyment of playing with the rattle.

Additional advantages of this invention will become apparent from the description which follows, taken in conjunction with the accompanying drawings.

BEST MODE FOR CARRYING OUT THE INVENTION

Figure 1:
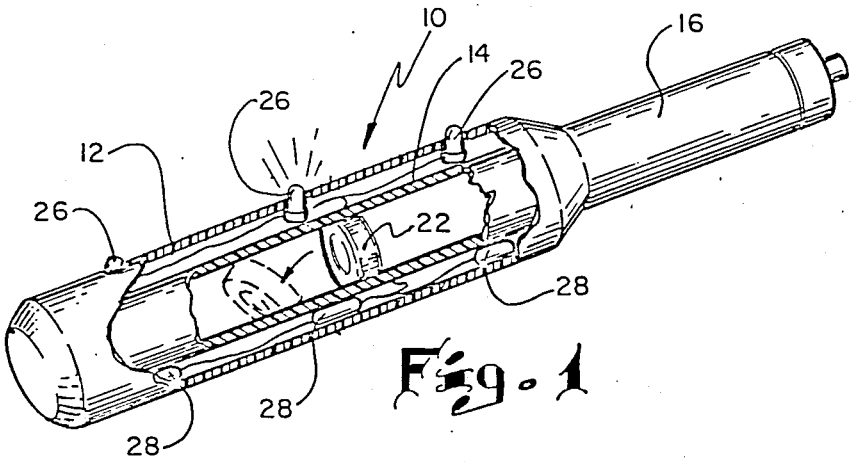
FIG. 1 is a perspective view of the illuminated rattle of this invention, with parts broken away for clarity of illustration.
Figure 2:
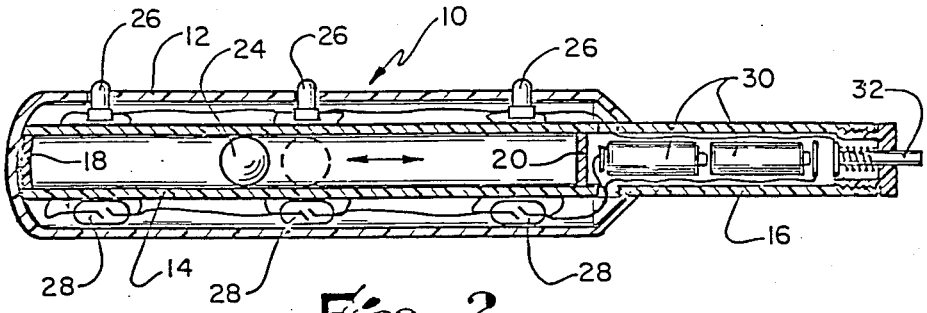
FIG. 2 is a horizontal section through the rattle of FIG. 1 showing further details thereof.

In accordance with this invention, a rattle 10 is provided which has a generally cylindrical housing 12 which contains a tube 14 that lies along the axis of the housing. Conveniently, tube 14 extends beyond the housing at one end to form a handle 16 for manipulating the rattle. As best seen in FIG. 2, tube 14 has a first closed end 18 and a second closed end 20 between which a sound producing device such as disk 22 in FIG. 1 or ball 24 in FIG. 2 can roll to produce a noise and to illuminate the device as described below. In this regard, disk 22 will roll end over end as illustrated in FIG. 1 and ball 24 will roll along the tube.

Figure 3:
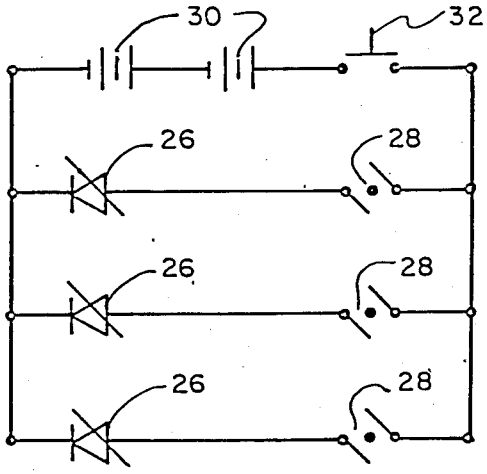
FIG. 3 is a diagram of the electrical circuit for the rattle.

Conveniently, a plurality of lights such as light emitting diodes 26 is mounted along one side of tube 14 and extend through the side of housing 12, as shown. They are each connected in series with reed switches 28 to form separate light sets of a light emitting diode 26 and a reed switch 28. These light sets are then connected in parallel, as best seen in FIG. 3, to batteries 30 mounted in handle 16, as shown in FIG. 2. If desired, a push button switch 32 can be provided in the circuit and is mounted on the end of handle 16. Conveniently, a disk 22 and ball 24 are made of magnetic material so that when they roll past the reed switches, they will be momentarily closed causing their respective light emitting diodes to be illuminated creating a pleasing effect for the infant or child who is playing with the rattle.

It will be understood that push button switch 32 is optional. If it is not in the circuit, then every time the rattle is tipped back and forth, the rolling ball or disk will make a noise as it rolls through the tube and will sequentially and momentarily illuminate each of the light emitting diodes. With the push button switch 32 in the circuit, it is necessary for the infant playing with the rattle to depress the switch in order to cause the lights to be illuminated upon manipulation of the rattle. Conveniently, when the device is provided with disk 22, the disk will roll end over end and will actually momentarily illuminate an LED 26 two times with each passage since the disk will turn end over end causing the reed switch to be closed twice with each passage of the disk. It will be understood that either the disk or the ball will be used but not both at the same time. Since the ball is also magnetic, it will also close each of the switches as it passes over it.

Advantageously, the LEDs may be of different colors to further enhance the enjoyment of playing with the rattle.

Figure 4:
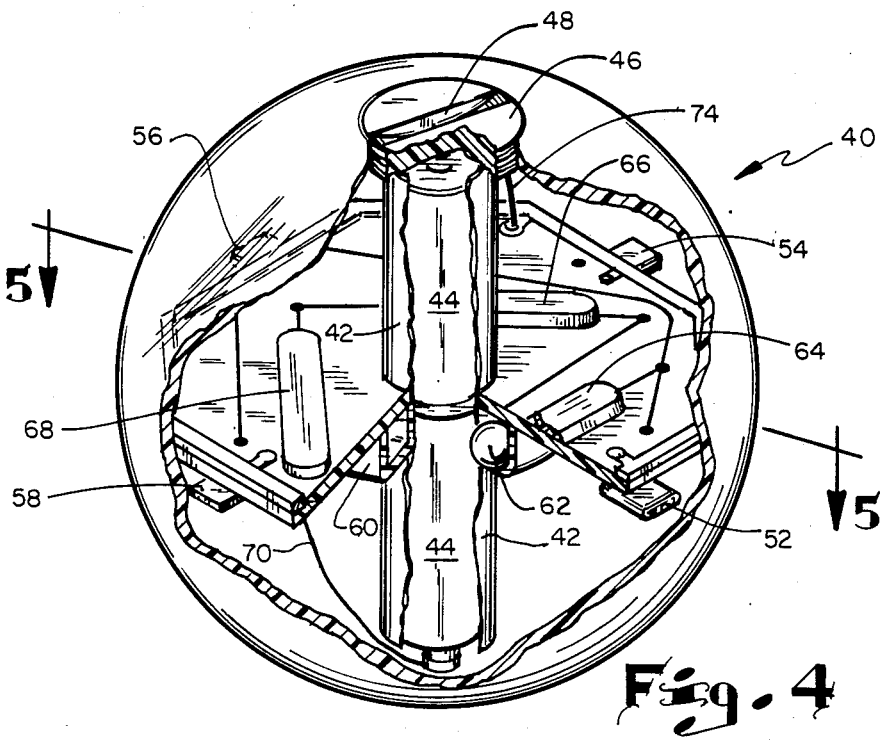
FIG. 4 is a perspective view of an alternative form of illuminated rattle of this invention, with parts broken away for clarity of illustration.
Figure 5:
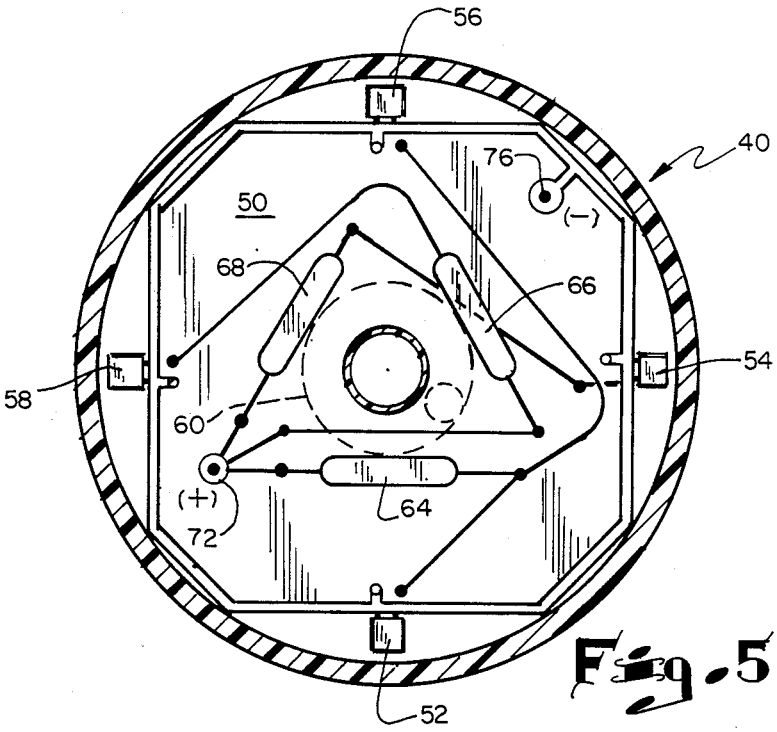
FIG. 5 is a horizontal section, taken along line 5—5 of FIG. 4, showing further details of the invention.

A further embodiment of the invention is illustrated in FIGS. 4 and 5, wherein a spherical housing 40 is provided. Conveniently, this housing, or at least a portion of it, is transparent for viewing intermittently illuminated lights or light emitting diodes, as described below. A tubular battery housing 42 extends axially through spherical housing 40 for receiving batteries, such as a pair of batteries 44, as illustrated. The end of the housing is closed by a threaded cap 46 having a transfer slot 48 so that it can be removed for replacing the batteries.

A circuit board 50 is provided, which lies along a plane passing through the equator of the spherical housing 40 and surrounds battery housing 42, as shown in FIG. 4. Light emitting diodes 52, 54, 56, and 58 are spaced around the periphery of circuit board 50 and are secured thereto by appropriate leads. An annular trackway 60 is provided on one side of circuit board 50 and extends around battery housing 42. Within this trackway is a magnetic member, such as ball 62. It will be apparent that as spherical housing is rolled around or turned, ball 62 will move along trackway 60 toward the lowest point in the trackway. Spaced on the opposite side of circuit board 50 adjacent the trackway are a plurality of reed switches 64, 66 and 68.

Figure 6:
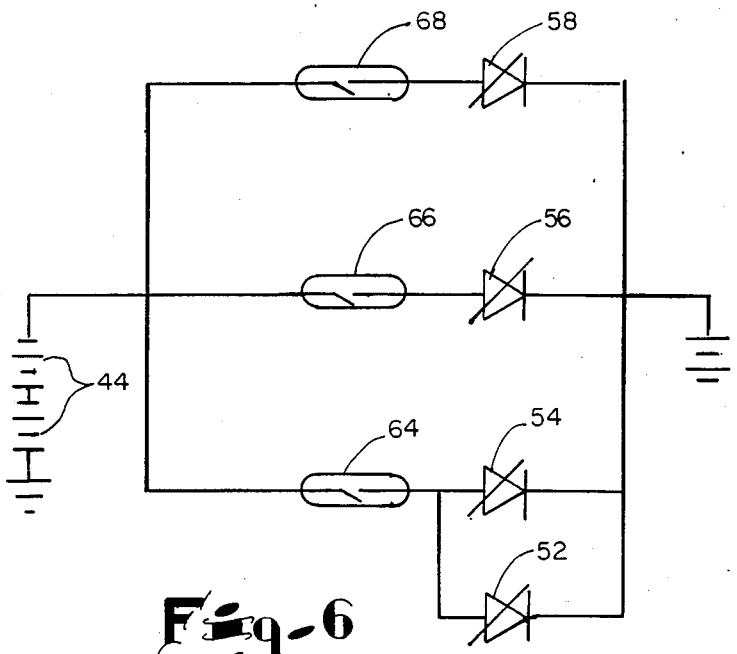
FIG. 6 is a schematic diagram of the electrical circuit for the toy of FIG. 4.

Conveniently, the positive end of batteries 44 is connected by means of a wire 70, shown in FIG. 4, to a positive terminal 72 on circuit board 50, as best seen in FIG. 5. Similarly, a wire 74 extends from the grounded or negative end of the batteries, as shown in FIG. 4, to a negative terminal 76, shown in FIG. 5. By viewing FIGS. 5 and 6, it can be seen that reed switch 64 is connected in series with light emitting diodes 52 and 54. Reed switch 66 is connected in series with light emitting diode 56 and reed switch 68 is connected in series with light emitting diode 58. Thus, as the toy is rolled around on the floor or otherwise manipulated, whenever ball 62, moving along track 60, passes in the vicinity of one of the reed switches, that reed switch will be closed momentarily to illuminate the light emitting diodes which are in series with it. It will be understood that the circuit board could be much smaller than shown and could be positioned in a different portion of the device. Also, the number of light emitting diodes could be increased or decreased as desired.

From the foregoing, the advantages of this invention are readily apparent. A rattle has been provided wherein the noise making device within the rattle serves a dual purpose of not only making noise but also providing intermittent illumination of the device to further enhance the enjoyment of playing with it. This is accomplished by connecting light-emitting diodes in series with reed switches that are momentarily closed by the noise-making device which is made of magnetic material, as it passes over them.

In one form of the invention, the toy is elongated in shape and the magnetic member moves along a straight tubular path. In another embodiment, the magnetic member moves along an annular path and the toy is spherical.

The invention has been described in detail with particular reference to preferred embodiments thereof, but it will be understood that variations and modifications can be effected within the spirit and scope of the invention.

I claim:

1. A hand operated toy which provides both a sound and illumination response to the user, said toy comprising:

a generally spherical housing;

a magnetic member movable along a predetermined path within said housing upon turning or rolling said housing;

a plurality of normally open reed switches mounted along said predetermined path so as to be sequentially closed each time said magnetic member moves along said path past said switches;

battery means mounted in said housing; and a plurality of lights in said housing connected in circuit with said battery means and said switches so that at least one of said switches is closed by said magnetic member.

2. Apparatus, as claimed in claim 1, wherein:

said path along which said magnetic member moves is circular.

3. Apparatus, as claimed in claim 2, wherein:

said battery means lies along an axis of said housing; and said circular path is concentric with said axis.

4. Apparatus, as claimed in claim 2, further including:

a circuit board mounted adjacent said circular path with said reed switches arranged thereon around said circular path.

5. Apparatus, as claimed in claim 4, wherein:

said lights are arranged around the periphery of said circuit board and are viewable, when illuminated, through said housing.

6. Apparatus, as claimed in claim 5, further including:

a conductive ring around the periphery of said circuit board for connecting said light in said circuit.

7. Apparatus, as claimed in claim 3, wherein:

said housing has a removable battery cover along said axis for gaining access to said battery means.

8. A hand operated toy which provides both a sound and illumination response to the user, said toy comprising:

a generally spherical housing;

a magnetic member movable along a circular path within said housing upon turning or rolling said housing;

a plurality of normally open reed switches mounted along said predetermined path so as to be sequentially closed each time said magnetic member moves along said path past said switches;

battery means mounted in said housing;

a plurality of lights in said housing connected in circuit with said battery means and said switches so that at least one of said lights is illuminated each time one of said switches is closed by said magnetic member;

said battery means lies along an axis of said housing said circular path being concentric with said axis;

a circuit board mounted adjacent said circular path with said reed switches arranged thereon around said circular path;

said lights being arranged around the periphery of said circuit board and being viewable, when illuminated, through said housing; and a conductive ring around the periphery of said circuit board for connecting said lights in said circuit.

9. Apparatus, as claimed in claim 8, wherein:

said magnetic member is spherical.

10. Apparatus, as claimed in claim 8, wherein:

said battery means includes a battery tube lying along said axis for containing a plurality of batteries arranged in series.

11. Apparatus, as claimed in claim 8, further including:

sound producing means in circuit with one of said reed switches.

12. An infant toy for rolling or turning which can provide both sound and illumination in response to the movement of said toy, said toy comprising:

a tubular housing for at least one battery, said housing having a longitudinal axis, a negative contact at one end and a positive contact at the other end;

a circuit board in the form of an annular disk surrounding said tubular housing and lying in a plane perpendicular to said axis;

a circular trackway adjacent said circuit board and extending around said housing;

an electrical circuit on said circuit board including lights arranged in series with reed switches positioned around said trackway; and a magnetic member in said trackway movable therearound by manipulation of said toy to selectively close said reed switches to illuminate at least one of said lights.

13. Apparatus, as claimed in claim 12, further including:

a spherical housing around said tubular housing and said circuit board.

14. Apparatus, as claimed in claim 13, wherein:

at least a portion of said spherical housing is transparent for viewing said lights when illuminated.

15. Apparatus, as claimed in claim 12, wherein:

said magnet is spherical.

* * * * *